United States Patent [19]

Mueller et al.

[11] Patent Number: 5,007,466

[45] Date of Patent: Apr. 16, 1991

[54] METHOD AND APPARATUS FOR FILLING ICE CREAM CONTAINERS

[75] Inventors: Martin J. Mueller, Palm Harbor, Fla.; Martin Mueller, Wonder Lake, Ill.; Michael A. Weingandt, Duneden, Fla.

[73] Assignee: Osgood Industries, Inc., Oldsmar, Fla.

[21] Appl. No.: 381,858

[22] Filed: Jul. 19, 1989

[51] Int. Cl.[5] ..... B65B 3/34

[52] U.S. Cl. ..... 141/1; 141/150; 141/167; 141/278; 141/91; 141/95

[58] Field of Search ..... 141/129, 148, 149, 150, 141/151, 152, 144, 165, 167, 237, 238, 242, 244, 194, 275, 276, 277, 278, 1, 95, 90, 91, 125, 126

[56] References Cited

U.S. PATENT DOCUMENTS

| | | | |
|---|---|---|---|
| 2,340,536 | 2/1944 | Joplin | 141/165 |
| 2,351,392 | 6/1944 | Biner | 141/152 |
| 2,932,329 | 4/1960 | Gardner et al. | 141/148 |
| 3,139,914 | 7/1964 | Bingham | 141/150 |
| 3,270,783 | 9/1966 | Hughes | 141/1 |
| 3,543,813 | 12/1970 | Creed | 141/148 |
| 3,967,659 | 7/1976 | Warner et al. | 141/148 |
| 4,417,610 | 11/1983 | Waldström et al. | 141/91 |
| 4,445,549 | 5/1984 | Bernhard | 141/148 |
| 4,508,148 | 4/1985 | Trechsel et al. | 141/148 |
| 4,655,265 | 4/1987 | Duteurtie et al. | 141/129 |
| 4,893,660 | 1/1990 | Berg et al. | 141/144 |

FOREIGN PATENT DOCUMENTS

| | | | |
|---|---|---|---|
| 1292740 | 3/1962 | France | 141/129 |

*Primary Examiner*—Henry J. Recla
*Assistant Examiner*—Casey Jacyna
*Attorney, Agent, or Firm*—Dressler, Goldsmith, Shore, Sutker & Milnamow, Ltd.

[57] ABSTRACT

An ice cream filling apparatus for simultaneously filling multiple ice cream containers as they move along a predetermined path of travel extending between a receiving station and a discharge station and a method of operating the filling apparatus in a manner controlling the volumetric fill of each container as a function of the speed that the container moves along its predetermined path of travel. The filling apparatus includes a transport and filling mechanism which quickly and easily adapts to different size and shape containers and includes a series of cantilevered container supports. Each container support individually holds and positions an ice cream container beneath a filling nozzle in a manner facilitating clean operation of the filling apparatus and such that board caliper and bouncing of the container have an inconsequential effect on volumetric fill accuracy of the filling apparatus. The flow of ice cream to each container is automatically stopped at the discharged station and the filled ice cream container is automatically removed from the transport and filling mechanism in a smooth and continuous motion while permitting uninterrupted movement of the transport and filling mechanism toward the receiving station. A supply mechanism positively provides containers to the receiving station in timed relation with the arrival of a container support at the receiving station.

24 Claims, 7 Drawing Sheets

61
136
135
74
70
68
3
60
26
76
64
58
72
88
88
138
86
84
137
138
78
28
5
62
C
50
5
49
48
46
52
54
24
32
132
40
30
134
42
110
114
34
112
122
118
124
120
116
128
84
14
80
82

METHOD AND APPARATUS FOR FILLING ICE CREAM CONTAINERS

FIELD OF THE INVENTION

The present invention relates to an ice cream filling apparatus and, more particularly, to an automated apparatus for simultaneously filling multiple ice cream containers as they move along a predetermined path of travel while facilitating smooth, clean transfer of unfilled and filled containers to and from the filling apparatus. The present invention further relates to a method for automatically controlling volumetric fill of each of the ice cream containers by controlling their speed of movement along their predetermined path of travel.

BACKGROUND OF THE INVENTION

Ice cream containers are provided in a plurality of shapes and sizes. Some ice cream containers are square or brick shaped and some are round. To provide customers with a choice, ice cream containers are provided in several different sizes. Moreover, some ice cream containers are filled from an end while other containers are filled from the top.

The considerable difference in sizes, shapes, and fill openings of the containers heretofore necessitated customizing an ice cream filling machine to match the particular ice cream container being filled. As will be appreciated, such ice cream filling machines were expensive and limited in their performance to the particular container being filled.

Heretofore known ice cream filling machines normally have a single fill head from which ice cream continually flows. During an ice cream filling operation, ice cream containers are moved in successive order beneath the fill head. Because of board caliper and inadequate side supports for the container, however, the amount or volume of ice cream filled in each container varies depending upon the extent of container expansion. As a result, some containers may be overfilled while other containers may be underfilled. Moreover, round containers can be especially difficult to accurately and efficiently fill with ice cream.

In conventional ice cream filling machines, the containers are moved beneath the fill head in a jerking motion. This jerking motion is used to slice or cut-off the ice cream flow into the filled container while quickly arranging an empty ice cream container beneath the fill head. As will be appreciated, regardless of the rapidity with which the containers are moved relative to the fill head, the continuous flow of ice cream from the fill head will cause some ice cream to flow between and about successive containers.

The ice cream not flowing into the containers is wasted thus reducing productivity. Moreover, the ice cream flowing between successive containers is not conducive to a clean environment normally associated with the food industry.

SUMMARY OF THE INVENTION

In view of the above, and in accordance with the present invention, there is provided an automated apparatus for filling multiple ice cream containers as they move along a predetermined path of travel while facilitating smooth and clean transfer of unfilled and filled ice cream containers to and from the apparatus. The present invention further contemplates a method of automatically controlling volumetric fill of each container by controlling the container's movement along the predetermined path of travel.

A salient feature of the present invention concerns the provision of a container transport and filling mechanism. The container transport and filling mechanism includes a transport apparatus which supports a plurality of ice cream containers for movement along a predetermined path of travel extending between a receiving station and a discharge station. The container transport and filling mechanism further includes an apparatus, driven in timed relation with the transport mechanism, for simultaneously filling more than one of the containers as the containers move along a segmented portion of their predetermined path of travel.

The transport apparatus adapts to any size, shape, or fill opening of an ice cream container thereby lending versatility to the present invention. In a preferred embodiment, the transport apparatus comprises a plurality of cantilevered container supports arranged in spaced relation relative to each other to facilitate clean operation of the transport filling mechanism. Each container support individually carries an ice cream container toward an end thereof. The container is supported such that board caliper and bouncing have an inconsequential effect on volumetric fill accuracy of the filling apparatus.

In the illustrated embodiment, each container support includes a wire structure for receiving and supporting an ice cream container. The wire structure is connected to the container support so as to facilitate interchangeability between different wire structures. Thus, the transport and filling mechanism of the present invention is quickly and readily adaptable to receive and support containers of different sizes, shapes, and fill openings simply by changing the wire structure used in conjunction with the container support. Each container support may further include a resiliently biased arm which positively positions and holds the ice cream container as the transport apparatus moves the container along its predetermined path of travel.

As the container moves along its predetermined path of travel, the transport apparatus vertically positions the container supports relative to the filling apparatus to facilitate filling of the containers. In a preferred form of the invention, upper and lower cams are used to vertically position the container support relative to the filling apparatus.

The filling apparatus comprises a centrally disposed ice cream distribution manifold defining an ice cream outlet and which is connected to a source of ice cream. The filling apparatus further comprises a series of equally spaced conduits which radially extend outward from the distribution manifold and move in timed relation with the transport apparatus for delivering ice cream from the ice cream outlet to each ice cream container as the containers move along their predetermined path of travel. Each conduit defines an inlet end which is moved relative to the outlet in the manifold to permit ice cream to pass through the conduit so long as the inlet end and the ice cream outlet are joined in fluid communication. In a preferred form, the opposite end of each conduit is fitted with an interchangeable filling nozzle.

The container transport and filling mechanism further includes a variable speed drive mechanism which controls movement of the ice cream container at least as it moves along the segmented portion of its travel in a manner affecting and controlling the volume of ice cream filled into the container. Preferably, the drive mechanism includes a variable speed electrical motor for driving both the transport apparatus and the filling apparatus in timed relation relative to each other. The drive mechanism further includes a fill sensing device arranged adjacent the container's predetermined path of travel for monitoring the volumetric fill of the container. The fill sensing device develops a feed back signal which automatically controls or adjusts the speed of the motor used to drive the transport and filling mechanism. When the volumetric fill of the containers varies beyond a predetermined parameter, as determined by the fill sensing device, the speed of the transport and filling mechanism is accordingly adjusted in a manner facilitating volumetric fill accuracy of the ice cream containers (i.e., increasing fill speed to reduce the fill level, and decreasing speed to increase the filling).

To complement and facilitate automation of the ice cream filling process, the ice cream filling apparatus of the present invention may further include an ice cream container supply mechanism which timely presents empty ice cream containers to the transport and filling mechanism at the receiving station. Preassembled ice cream containers are positively moved toward the receiving station of the transport and filling mechanism and are presented in timed relation with the arrival of each container support of the transport apparatus at the receiving station. The preassembled containers are provided to the supply mechanism in a manner providing sufficient time to allow an operator to check whether there is a sufficient backlog of containers to assure continued and uninterrupted operation of the transport and filling mechanism.

A container removal apparatus facilitates smooth and clean transport of each ice cream filled container from the transfer and filling mechanism. The container removal apparatus is provided at the discharge station of the transport and filling mechanism and comprises a stationary stop which inhibits movement of the containers past the discharge station and a container engagement device. The container engagement device is driven in timed relation with the transport and filling mechanism to positively remove individually stopped containers from the transport apparatus.

The stationary stop is designed to inhibit movement of the container while permitting uninterrupted and continual movement of the transport apparatus toward the receiving station. The container engagement device includes a driven pusher which positively removes filled ice cream containers from their predetermined path of travel and moves the filled container toward a conveyor apparatus for movement to an area remote from the transport filling mechanism of the present invention.

At the discharge station, the flow of ice cream through the filling apparatus has been stopped automatically and the container is vertically positioned beneath the filling apparatus. Moreover, the container is prevented from further movement along its predetermined path of travel. Although the container is stopped, the filling apparatus continues to move toward the receiving station conjointly with the transport apparatus. The relative movement between the filling apparatus and the filled ice cream container allows the filling nozzle to continually sweep over the top of the ice cream filled container thereby cutting off or shearing the ice cream in the container in a smooth continuous motion thereby facilitating cleaner operation and reducing the messiness involved with filling ice cream containers.

In accordance with the presently preferred and illustrated embodiment, the container transport and filling mechanism of the present invention is operated in either a filling mode of operation or a cleaning mode of operation. During the filling mode, the transport apparatus and filling apparatus operate conjointly to simultaneously fill a plurality of ice cream containers in the manner described above. In the cleaning mode, internal passages defined by the filling apparatus are cleaned, and if so desired, sterilized without requiring disassembly of the filling apparatus.

To enable the transport and filling mechanism to be operated in a cleaning mode, a cleaning system is provided for facilitating internal cleaning of the filling apparatus. Without necessitating disassembly, the cleaning system selectively permits a cleaning fluid to be supplied from the distribution manifold through the conduits and filling nozzles of the filling apparatus. A selectively operated camming mechanism positions the conduits in fluid communication with a source of pressurized cleaning fluid to effect cleaning of the filling apparatus.

The present invention further contemplates a method of filling containers with ice cream or the like. The preferred method includes the steps of (1) moving a preassembled ice cream container in a supported manner along a predetermined path of travel; (2) filling the ice cream container with ice cream as the container moves along a segmented portion of its predetermined path of travel; and, (3) controlling movement of the container at least as the container moves along the segmented portion of its predetermined path of travel thereby influencing the volume of ice cream deposited in the container.

The above-described method of filling ice cream containers may further comprise the step of presenting empty ice cream containers to a container transport apparatus for movement of the containers along the predetermined path of travel. Automated operation of the ice cream filling apparatus can be further enhanced through the steps of stopping filled ice cream containers at a removal station arranged adjacent the predetermined path of travel while permitting uninterrupted movement of the transporting mechanism; and, removing filled ice cream containers from their predetermined path of travel while permitting uninterrupted movement of the transport apparatus.

The ice cream filling apparatus of the present invention simultaneously fills and moves an ice cream container in a continuous motion. Therefore, the above-described problems and drawbacks of moving an ice cream container relative to the filling head during the filling process are substantially eliminated. Moreover, the ability of the present invention to simultaneously fill multiple ice cream containers as they move along a predetermined path is expected to substantially increase production rate of filled ice cream containers.

Better volume control and cleaner operation of the transport and filling mechanism are but two outstanding benefits achieved by monitoring the volumetric fill of the containers as they move along their predetermined path of travel. The monitored volumetric fill of the containers is used to automatically control and adjust the speed of the transport and filling mechanism in a manner avoiding overfilling and underfilling of the ice cream containers.

Moreover, the cantilevered design of the transport apparatus further facilitates clean operation of the transport and filling mechanism. By individually supporting each ice cream container being filled, the concerns over board caliper and bouncing of the container are reduced. Container supports having interchangeable wire structures for individually holding and supporting an ice cream container lend versatility to the present invention. As will be appreciated a quick change to a suitable support structure allows a container support to accept any size container being filled and properly orientates the container during filling.

Numerous other features and advantages of the present invention will become readily apparent from the following detailed description, the accompanying drawings, and the appended claims.

DETAILED DESCRIPTION OF A PREFERRED EMBODIMENT

Figure 1:
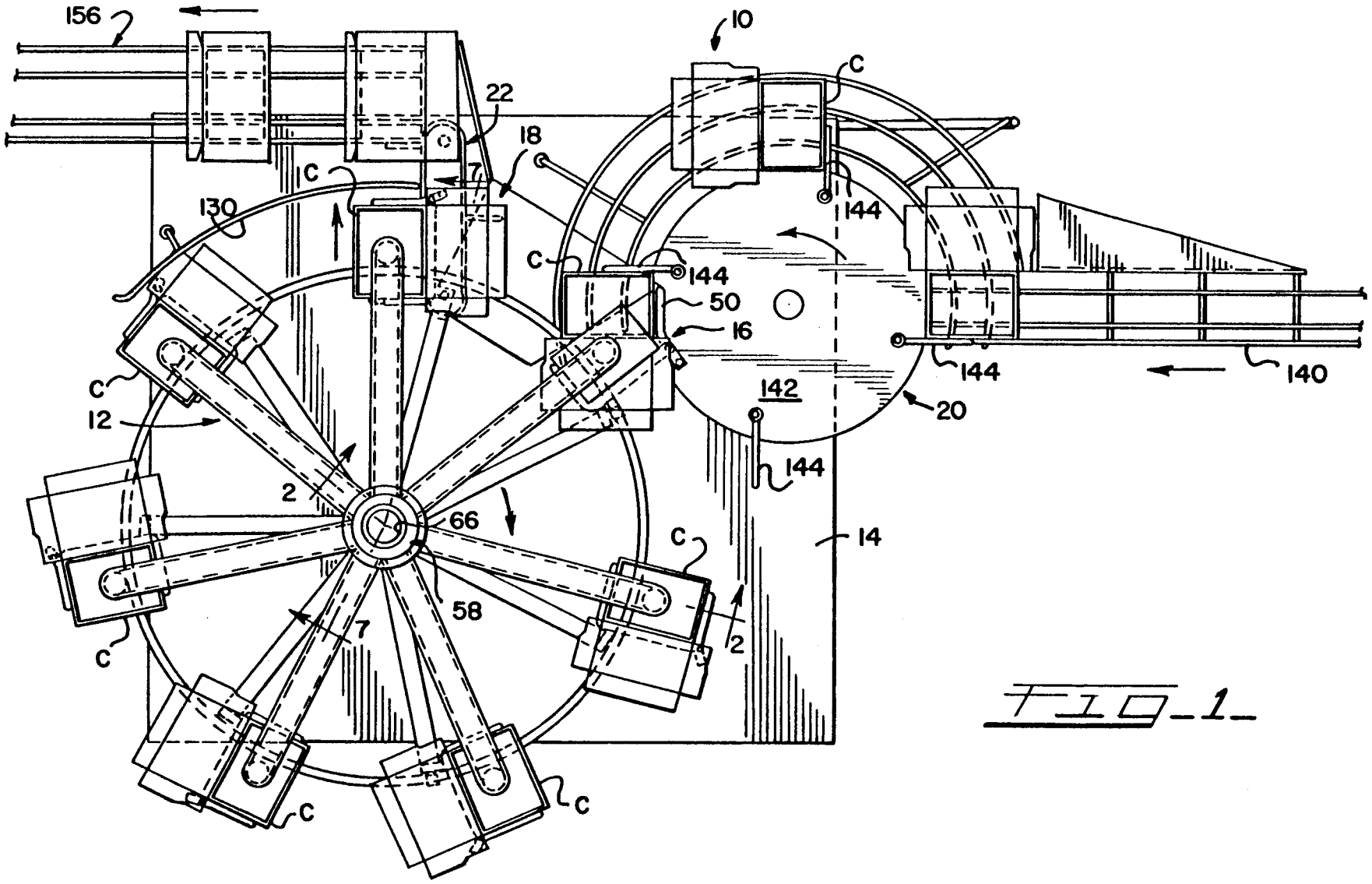
FIG. 1 is a schematic plan view of an ice cream filling apparatus incorporating principles of the present invention.

While the present invention is susceptible of embodiment in various forms, there is shown in the drawings, and will hereinafter be described, a preferred embodiment with the understanding that the present disclosure is to be considered as a exemplification of the invention and is not intended to limit the invention to the specific embodiment illustrated.

Referring now to the drawings, wherein like reference numerals indicate like parts throughout the several views, there is schematically illustrated in FIG. 1 an ice cream filling apparatus 10. Although generally rectangularly shaped preassembled containers C having covers or lids attached thereto and which are fillable from a top side thereof are schematically represented in the drawings, it will be appreciated that the apparatus of the present invention, as will be discussed in detail hereinafter, is versatile and easily adapted to change in order to facilitate different size and/or shape containers.

A salient feature of the present invention is its ability to fill at least one container C with ice cream as a function of the speed with which that container moves along a predetermined path of travel. To effect such ends, and as best illustrated in FIG. 1, the apparatus 10 of the present invention is provided with a container transport and filling mechanism 12 arranged on a stationary frame 14. As will be discussed in detail hereinafter, the transport and filling mechanism 12 accurately fills containers C with ice cream while they simultaneously move along a predetermined, preferably arcuate, path of travel extending between a receiving station 16 and a discharge station 18.

In the illustrated embodiment, a container supply mechanism 20 complements the transport and filling mechanism 12 by presenting empty ice cream containers to the mechanism 12 with the lids of the containers (when the containers are so provided) in an open position. As illustrated, a container removal apparatus 22 is provided at the discharge station 18 of the mechanism 12.

Figure 2:
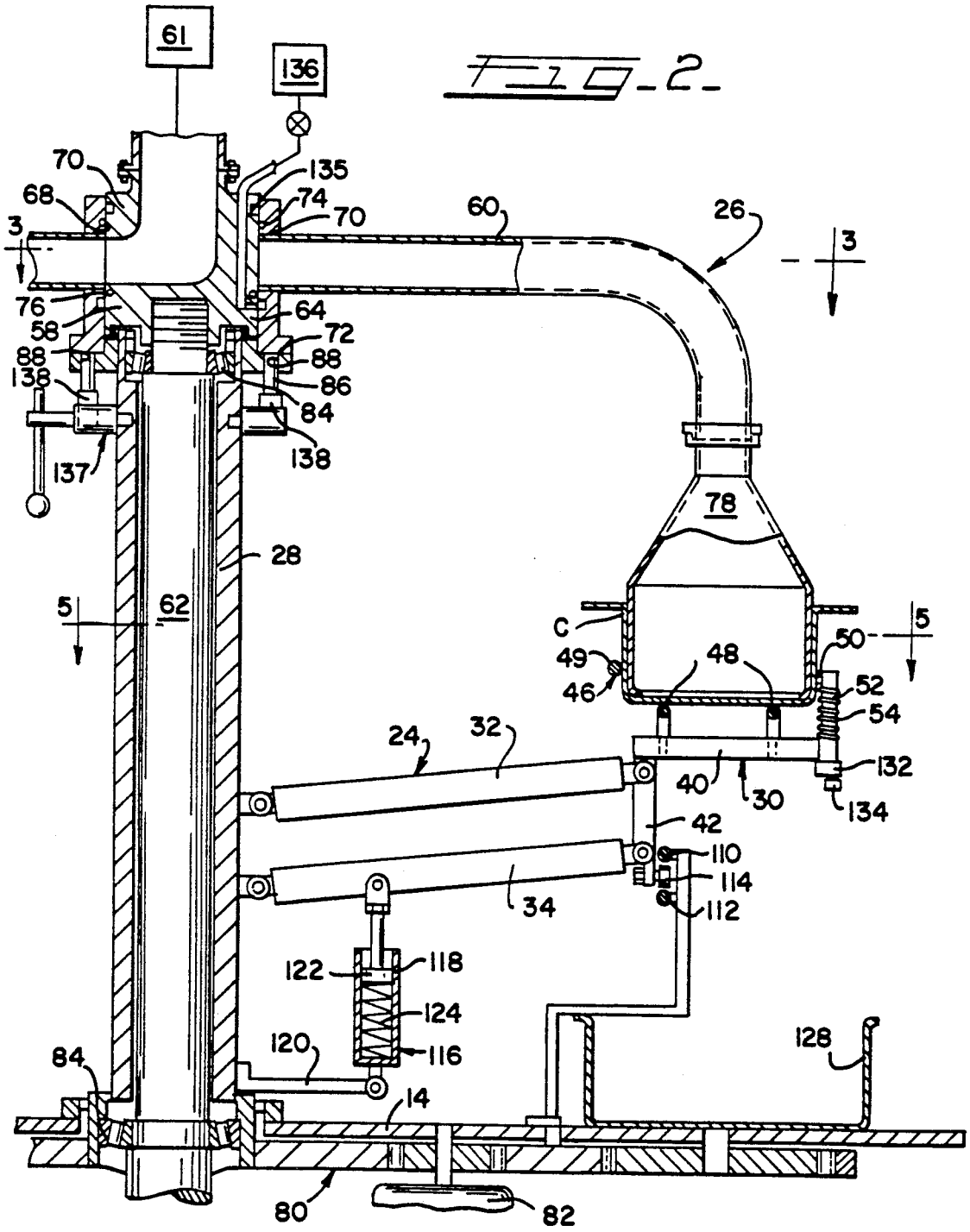
FIG. 2 is a sectional view taken along line 2—2 of FIG. 1.

Turning to FIG. 2, the transport and filling mechanism 12 is comprised of a transport apparatus 24 and a filling apparatus 26. The purpose of the transport apparatus 24 is to vertically support and continually move at least one and preferably multiple ice cream containers along a predetermined path of travel. The filling apparatus 26 accurately fills the containers with ice cream as they continually move along their predetermined path of travel.

In the illustrated embodiment, the transport apparatus 24 includes a hollow support member 28 vertically extending from and rotatably supported by the frame 14 and a series of cantilevered containers supports 30. Intermediate its ends, support member 28 provides a common support for the container supports 30 which are equally spaced in relation to each other.

The cantilevered design of the transport apparatus enhances clean operation during a filling operation and allows each ice cream container C to be individually supported in a manner facilitating volumetric fill accuracy of the container. Moreover, the board caliper effects and bouncing of the container are minimized by the cantilevered design of the transport apparatus 24.

In a preferred form, seven cantilevered container supports 30 are provided in equally spaced relation to each other. Since the container supports are substantially similar to each other, only a single container support will be described in detail with the understanding that the other container supports are constructed in substantial accordance therewith.

As illustrated, each container support 30 is joined to the support member 28 by a pair of parallel arms 32 and 34 which are joined to each other at opposite ends. At an inner end, the arms 32 and 34 are pivotally connected in vertically spaced relation to the support member 28. The opposite ends of arms 32 and 34 are pivotally connected in vertically spaced relation to the container support 30.

Preferably, each container support 30 of the present invention includes a generally horizontal member 40 with a bracket 42 depending therefrom. As illustrated, outer ends of each arm 32 and 34 are pivotally connected to the bracket 42. The illustrated pivotal arrangement for the arms 32 and 34 maintains member 40 of the container support 30 substantially horizontal as it moves along a predetermined path of travel regardless of the angular disposition of arms 32 and 34.

To inhibit movement of an ice cream container relative to the container support as the transport apparatus 24 moves along its predetermined path of travel, each container support further includes a suitably shaped rigid wire structure 46. The wire structure 46 is releasably connected to member 40. In the illustrated embodiment, wire structure 46 includes a pair of laterally spaced, generally horizontal wire members 48 which are secured in vertically spaced relation to member 40 and which define a base for supporting an ice cream container C. The wire structure 46 includes another wire member 49 which is preferably interconnected with wire members 48 to embrace and support the side surfaces of the container C to reduce bowing or board caliper effects of the container during filling.

Figure 6:
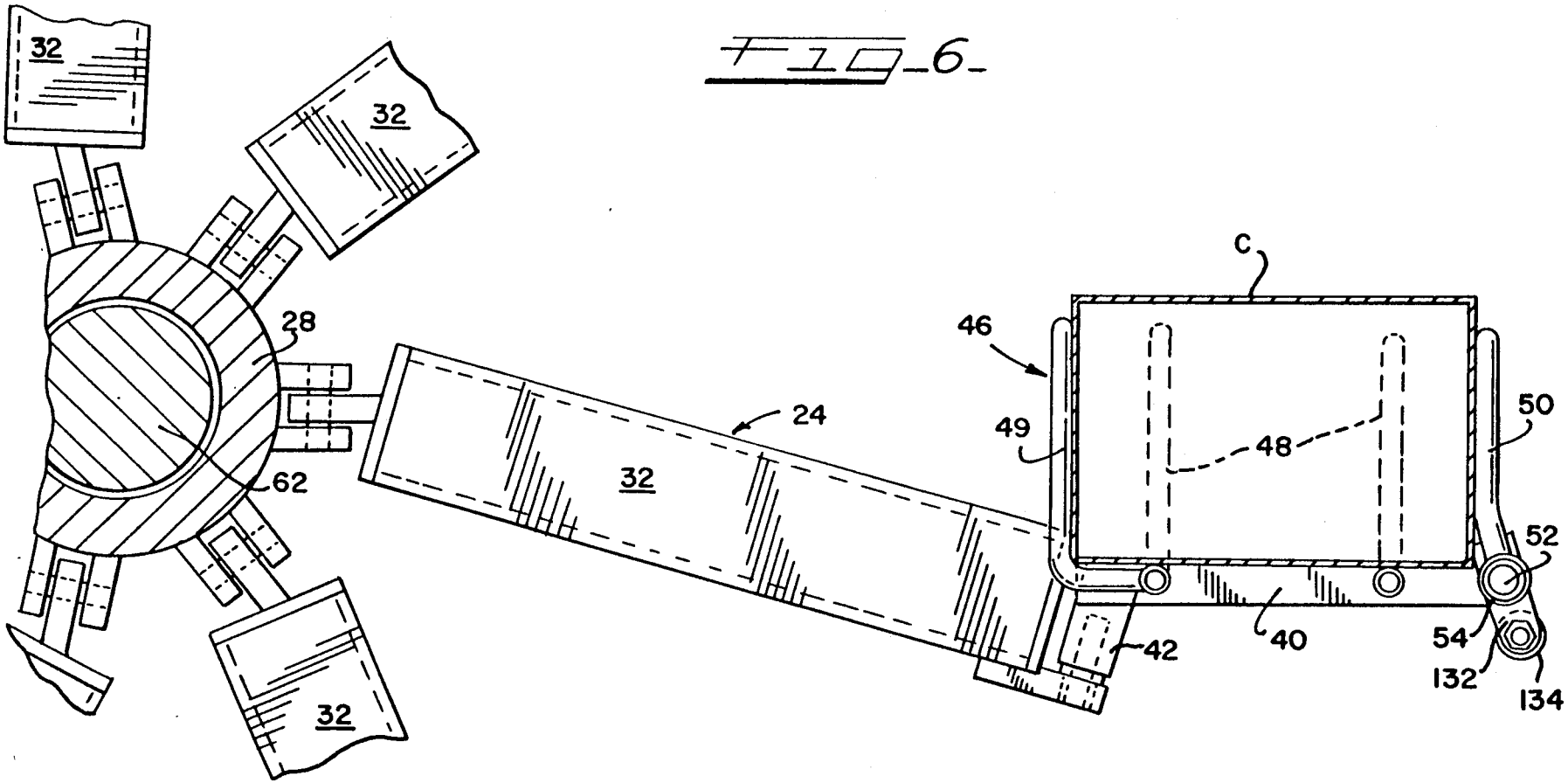
FIG. 6 is an enlarged fragmentary plan view taken along line 6—6 of FIG. 2.
Figure 7:
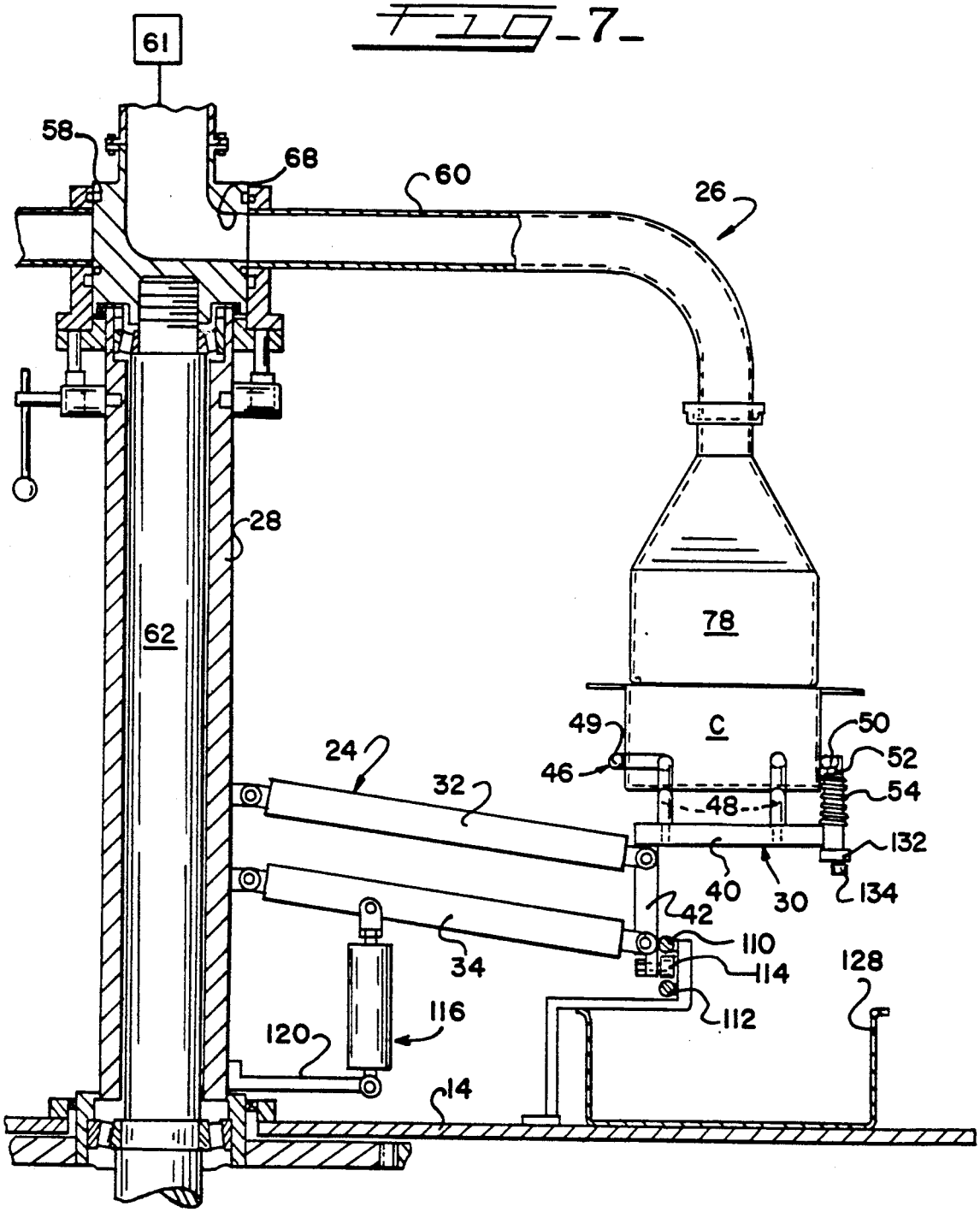
FIG. 7 is a sectional view similar to FIG. 2 but taken along line 7—7 of FIG. 1.

To promote accurate positioning of an ice cream container C, each container support 30 further includes a pivotal arm 50 arranged on the opposite side of the container from wire member 49. Arm 50 is spring biased to apply a horizontally directed force against the side of the container. In the preferred embodiment, and as illustrated in FIGS. 6 and 7, arm 50 is pivotal about an upstruck pin 52 extending from the member 40. A torsion spring 54 is provided to resiliently bias the arm 50 in a manner urging the container C into position on the container support 30.

Returning to FIG. 2, the filling apparatus 26 is capable of individually filling containers C with ice cream as the containers move along a segmented portion of their predetermined path of travel. The filling apparatus 26 preferably includes a centrally disposed ice cream distribution manifold 58 with a series of rigid tubular conduits 60 extending radially outward from the manifold 58. The manifold 58 is connected to a source of ice cream 61 and serves to distribute ice cream to each of the conduits for subsequent delivery to the containers moving along their predetermined path of travel.

In the illustrated embodiment, manifold 58 is rigidly supported at one end of a stationary support shaft 62 extending upward from and supported by frame 14. Preferably, shaft 62 telescopically extends upwardly through support member 28. As illustrated in FIGS. 2, 3, 4 and 5, manifold 58 defines an outer cylindrical mounting surface 64. Manifold 58 further defines a distribution channel 66. One end of channel 66 is connected to the source of ice cream 61. The opposite end of channel 66 defines an ice cream outlet 68 opening about a predetermined arcuate portion of mounting surface 64.

As best seen in FIG. 2, an inner end of each tubular conduit 60 is supported by an annular hub 70. Hub 70 is rotationally driven about and is vertically movable relative to mounting surface 64 of the manifold 58. As illustrated, an annular shoulder 72, provided at an upper end of support member 28, normally positions the hub 70 such that the inner or inlet end of each conduit 60 is vertically aligned with the outlet 68 of the distribution manifold 58. By such construction, and for a segmented portion of its travel about the mounting surface 64 of the manifold 58, each inlet end of a conduit is joined in fluid communication with the ice cream outlet 68 of the manifold 58.

A pair of annular seal rings 74 and 76 are provided to inhibit ice cream from leaking between the annular hub 70 and the mounting surface 64 of manifold 58 thereby facilitating clean operation of the filling apparatus. As illustrated, annular seal ring 74 is suitably received in an annular groove defined in hub 70 above the outlet 68 and above each inlet end of conduits 60. The other annular seal ring 74 is suitably received in an annular groove defined in mounting surface 64 of manifold 58 and below each inlet end of conduit 60.

The outer end of each tubular conduit 60 is preferably fitted with a filling nozzle 78. The filling nozzle 78 is releasably connected to the outer end of each conduit to promote interchangeability between filling nozzles. As will be understood, the shape of the filling nozzle 78 generally corresponds to the configuration of the container being filled with ice cream. Moreover, each filling nozzle is preferably made from polished stainless steel and is adapted to be slidably received within the container C to be filled with ice cream during the filling process.

A drive mechanism 80 is provided to move the transport apparatus 24 and filling apparatus 26 in timed relation relative to each other. As will be appreciated, the drive mechanism 80 controls movement of the ice cream containers C at least as they move along a segmented portion of their predetermined path of travel thereby effecting the volume of ice cream filled into each container.

Drive mechanism 80 preferably includes a variable speed electric motor 82 which is operatively connected to positively and rotatably drive the support member 28. As illustrated in FIG. 2, the support member 28 is journalled for rotation about the support shaft 62. Antifriction bearings 84 are preferably provided to reduce rotational friction between support member 28 and support shaft 62.

As illustrated in FIG. 2, secured to and depending from the lower end of hub 70 of the filling apparatus are a series of evenly spaced pins 86. Each pin slidably passes through a suitably formed aperture 88 defined by shoulder 72 on member 28. As will be understood, the pins 86 prevent relative rotation between member 28 and hub 70 while permitting vertical displacement of the hub 70 relative to the shoulder 72 and manifold 58. Thus, the rotational movement imparted to member 28 is transferred to the transport apparatus 24 and the filling apparatus 26.

Figure 9:
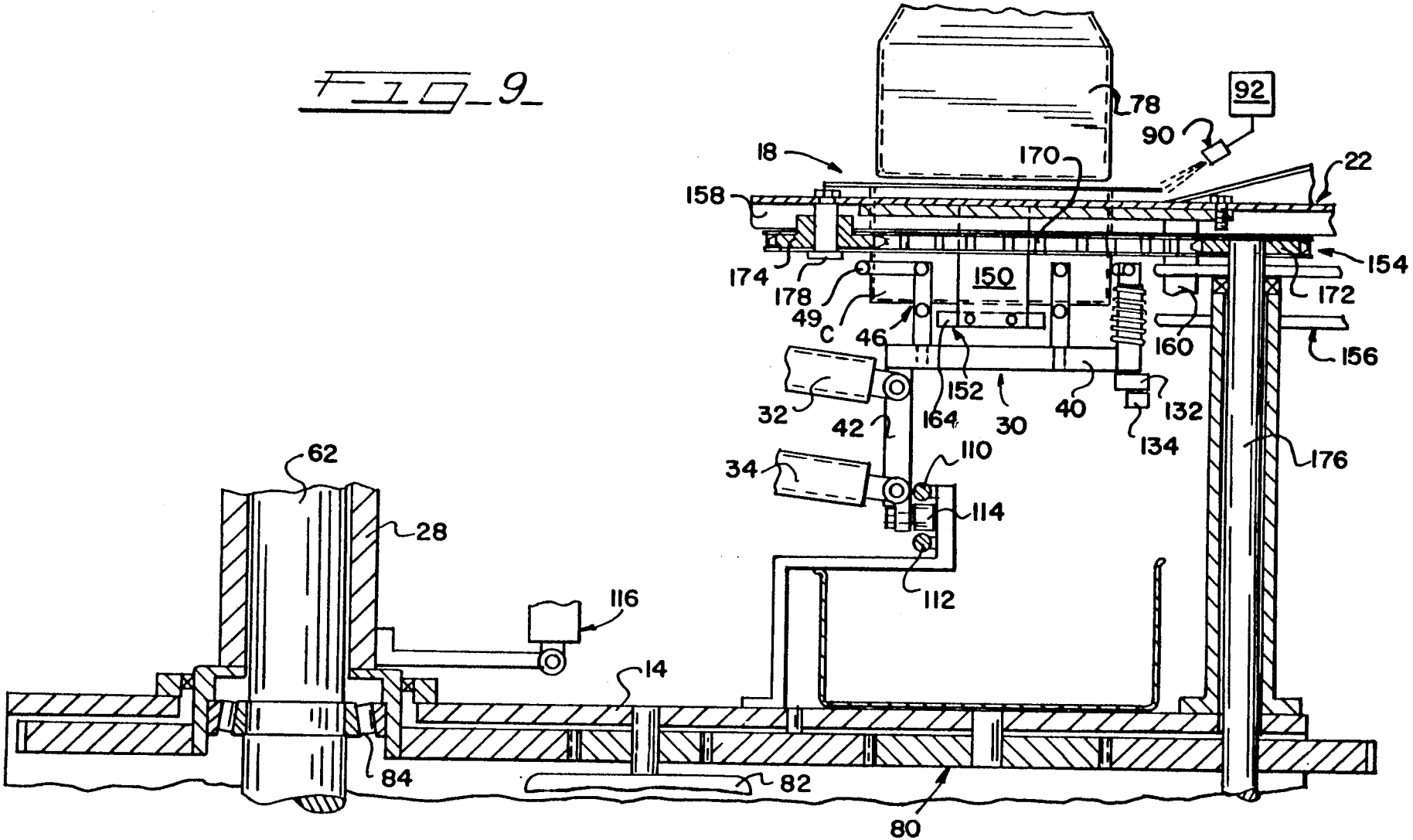
FIG. 9 is a fragmentary elevational view, partly in section, schematically illustrating the ice cream container removal apparatus and a proposed mechanism for operating same.

The rotational speed imparted to support member 28 and thereby to the transport apparatus 24 and filling apparatus 26 is controlled by a suitable sensor 90 which is located adjacent to the containers path of travel. As illustrated in FIG. 9, the sensor 90 is preferably arranged proximate to the discharge station 18 of the container transport and filling mechanism 12 for the purpose of monitoring the volumetric fill of the containers as they approach the discharge station 18.

As will be appreciated, the volumetric fill of a container can be measured by several different standards. For example, the volumetric fill of a container may be measured by the height of the container support 30 relative to the sensor 90; the height of a container C relative to the sensor 90; or, alternatively, the ice cream fill level in the container C when it reaches the discharge station.

The sensor 90 can be of any suitable type including photo sensors, infra-red sensors, or proximity sensors. The sensor 90 produces an output signal which is received at a control station 92. The control station 92 interprets the signal from the sensor 90 to be indicative of the volumetric fill of the container and controls the variable electric motor 82 and thereby the rotational speed of the container transport and filling mechanism 12 accordingly.

To facilitate vertical positioning of each container C relative to the filling nozzle 78 associated therewith, each container support 30 is vertically positioned as a function of its disposition along the predetermined path of travel. As illustrated in FIGS. 2, 7 and 9, upper and lower cam tracks 110 and 112, respectively, effectively control the vertical disposition of each container support 30 as it moves along the predetermined path of travel. As illustrated, the cam tracks 110 and 112 are supported above the frame 14 beneath the container support 30 and arcuately extend about support member 28. Each container support 30 has a cam follower 114 which is guided between the cam tracks 110 and 112. In the present invention, the cam follower 114 is rotatably carried at a lower end of bracket 42.

each container support 30 of the transport apparatus 24 is further provided with a balance mechanism 116. Each balance mechanism aids in vertically positioning the associated container support and the container C supported thereon as the container support is moved between the receiving and discharge stations. The balance mechanism 116 directs an upward force against the container support 30 such that each container support 30 follows the upper cam track 110 while allowing the container support 30 to be lowered as the container supported thereon is filled with ice cream.

As illustrated in FIG. 2, each balance mechanism 116 includes a hollow housing 118 connected between arm 34 and a bracket 120 radially extending beneath arm 34. Bracket 120 extends from and connected to support member 28. A slidable piston 122 is arranged for endwise movement in the housing 118. One end of the piston is articulately joined to arm 34. A spring 124, having a predetermined spring rate, is also accommodated within the housing 118 to act against the piston and against the weight of the container during the filling process. As will be appreciated, the balance mechanism can be provided in any of a variety of forms, such as a gas spring, or other biasing device.

The ability to move the transport apparatus 24 and filling apparatus 26 in timed relation relative to each other will facilitate clean operation of the filling apparatus 10. Some ice cream may, nevertheless, spill from the containers C. In this regard, an elongated through or pan 128 is provided beneath the predetermined path of travel of the containers C. The trough 128 is supported by the frame 14 and is sufficiently sized to capture ice cream falling from the containers during the filling process.

Figure 5:
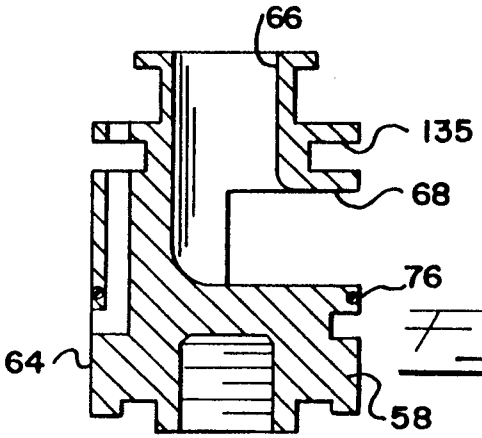
FIG. 5 is a sectional view taken along line 5—5 of FIG. 4.

As illustrated in FIG. 1, the transport and filling apparatus 12 further includes a cam 130 which acts against the pivotal arm 50 as each container support 30 approaches the discharge station 18. As illustrated, cam 130 has an arcuate profile which extends toward and terminates proximate to the discharge station 18. Turning to FIGS. 2 and 5, a crankarm 132 radially extends from the lower end of pin 52. The free end of crankarm 132 is provided with a cam follower 134 which coacts with cam 130 to timely move arm 50 against the action of spring 54 as the container support 30 approaches the discharge station.

Albeit normally operated in a filling mode of operation, the apparatus of the present invention is also operable in a cleaning mode of operation. As will be appreciated, the ability to efficiently internally clean and sterilize the distribution manifold 58 and conduits 60 is a primary concern when dealing with a food product such as ice cream. Therefore, the present invention includes a cleaning system capable of internally cleaning and, if so desired, sterilizing internal flow passages without requiring disassembly of the apparatus.

Figure 4:
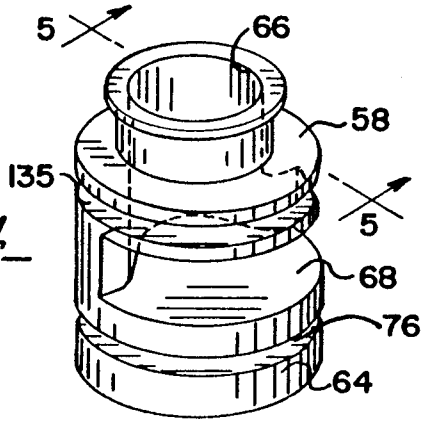
FIG. 4 is a perspective view of an ice cream discharge manifold forming part of the present invention.

As illustrated in FIGS. 2, 4 and 5, the cleaning system preferably includes an annular chamber 135 defined by the manifold 58 and opening to the mounting surface 64 thereof. Preferably, the annular chamber 135 is defined by the manifold 58 above the ice cream outlet 68 and above the upper seal ring 74 when the hub 70 is arranged on shoulder 72. The annular chamber 135 can be selectively placed in communication with a pressurized source of cleaning and/or sterilizing fluid 13 which is used to clean and sterilize internal passages within manifold 58, conduits 60, and the filling nozzle 78.

A manually operated mechanism 137 is provided for selectively moving the hub 70 and the inlet ends of the conduits 60 in a vertical direction relative to the manifold 58. In a preferred form, mechanism 137 includes a series of cams 138 which act in combination with the lower ends of pins 86 to vertically displace hub 70 relative to the manifold 58 so as to arrange each of the tubular conduits 60 in fluid communication with the annular cleaning chamber 135.

Again referring to FIG. 1, the container supply mechanism 20 is provided to supply empty containers to the receiving station 16 of the transport and filling mechanism 12. As illustrated, supply mechanism 20 includes an elongated slide 140 which leads to a drive mechanism which positively moves and presents empty containers to the receiving station 16.

The number of empty containers on the slide 140 provides an operator sufficient time to determine whether there is an adequate supply of containers to assure continued and uninterrupted operation of the transport and filling mechanism 12. The empty containers move along the slide 140 in a proper orientation for presentation to the receiving station 16. In those instances when the container to be filled is provided with a lid, a lid opening mechanism is provided to automatically open the container lid so as to inhibit interference during the filling process.

In the illustrated embodiment, the supply mechanism 20 moves and supports the empty containers along a substantially semi-circular path leading to the receiving station 16 of the transport and filling mechanism 12. As illustrated, the supply mechanism 20 includes a driver 142 which is rotatably driven in timed relation with the container transport and filling mechanism 12. A plurality of radially extending pushers 144 are releasably connected to driver 142 to individually engage and facilitate movement of the containers toward the receiving station. As will be appreciated, the pushers 144 are profiled to complement the particular shape of the container being supplied to the apparatus 12. Moreover, the pushers 144 are interchangeable with other pushers to add to the versatility of the invention.

The container removal apparatus 22 is provided for positively removing filled ice cream containers from the transport apparatus 24 at the discharge station 18. Moreover, the removal apparatus 22 inhibits movement of a filled ice cream container past the discharge station 18 while permitting continued and uninterrupted movement of the transport apparatus 24 toward the receiving station 16 to receive another empty ice cream container.

Figure 8:
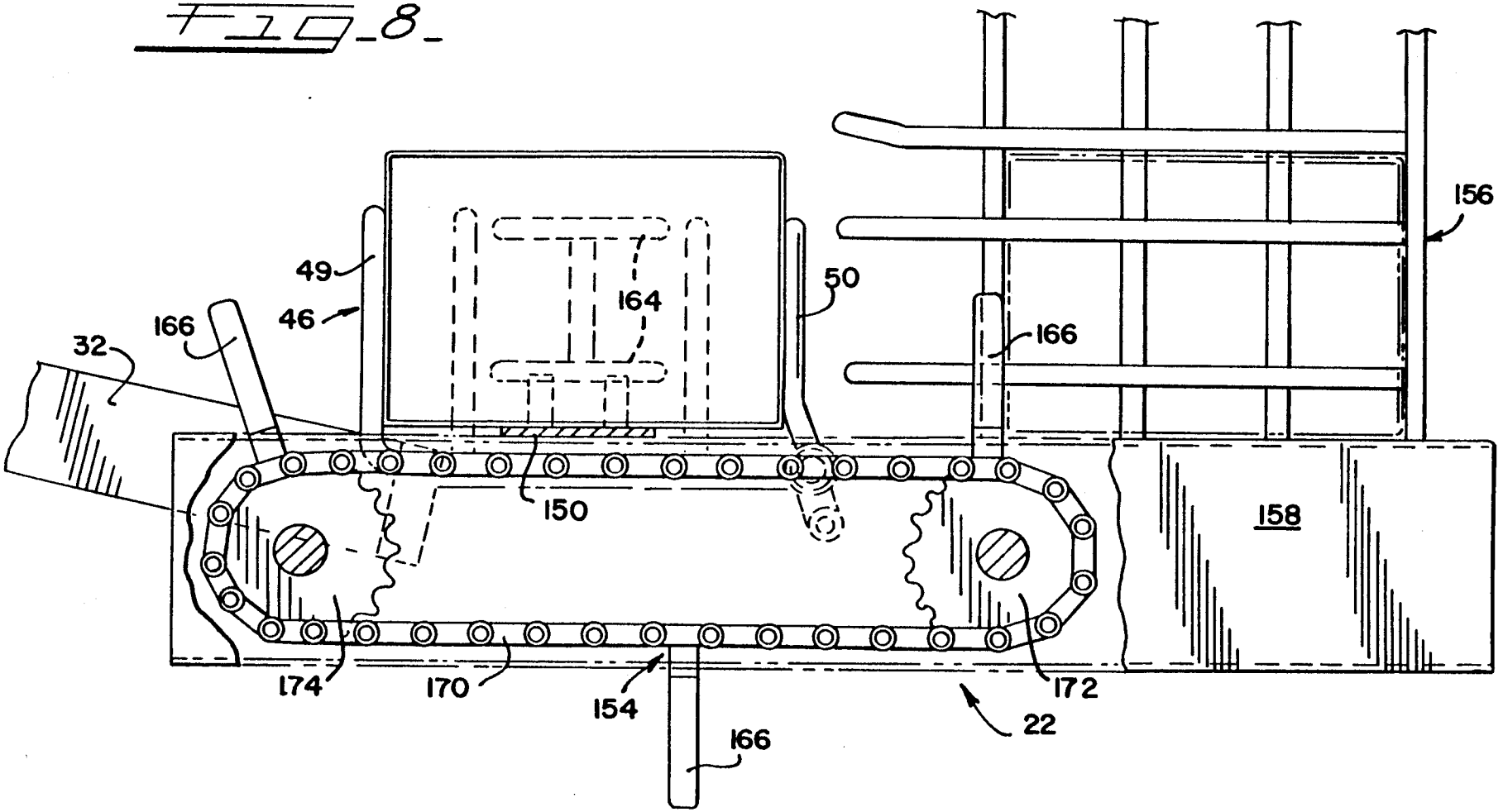
FIG. 8 is an enlarged fragmentary plan view, partly broken away, schematically illustrating an ice cream container removal apparatus forming part of the present invention.

Turning to FIGS. 8 and 9, the removal apparatus 22 includes a positive stop 150 which engages and prevents movement of a filled ice cream container past the discharge station 18. The removal apparatus further includes a support mechanism 152 for the stopped and filled ice cream container, and a container engagement device 154 which positively removes a filled ice cream container from the transport apparatus 24 and presents the filled ice cream container to a conveyor apparatus 156 (FIG. 1) for movement to an area remote from the transport and filling mechanism !2.

In the preferred embodiment, the removal apparatus 22 further includes an elongated housing 158 which is supported in a substantially horizontal cantilevered fashion from and is connected to a support 160. The support 160 extends upward from and is suitably attached to frame 14. As illustrated in FIG. 9, when the container support 30 arrives at the discharge station 18, the housing 158 extends above the container support 30 and in vertically spaced relation with the wire structure 46 so as to not inhibit or interfere with continual movement of the transport apparatus 24.

The stationary stop 150 preferably includes a depending, suitably configured plate which extends into the predetermined path of travel of the filled ice cream container so as to positively engage the container and inhibit its continued movement with the transport apparatus 24 along its predetermined path of travel. The stop 150 is connected at its upper end to the elongated housing 158. As illustrated in FIG. 9, the depending stop 150 is suitably sized to fit between the wire structure 46 and is vertically spaced from the container support 30 so as to not interfere with continual movement of the transport apparatus.

The support mechanism 152 horizontally extends between and beneath the base of the wire structure 46 but above member 40 and is suitably supported by the stop 150. In a preferred form, the support mechanism includes a wire structure 164. As seen in FIGS. 8 and 9, the wire structure 164 is designed to not interfere or inhibit continual movement of the container support 30 while providing support for a filled container which is deposited onto the wire structure 16 after the container support moves toward the receiving station.

In the illustrated embodiment, the container engagement device 154 includes a series of members or fingers 166 which move in a path extending above the support mechanism 152 substantially transverse to the predetermined path of travel of the containers. The engagement device 154 positively removes an ice cream filled container from the discharge station 18 of the transport and filling mechanism 12. Moreover, the container engagement device positively moves the ice cream filled container from the support mechanism 152 onto the conveyor apparatus 156 arranged adjacent to and, in a preferred form, extending transverse from the predetermined path of container movement.

In a preferred form, the engagement device 154 comprises a belt or chain 170 having fingers 166 connected to and extending therefrom. Belt 170 is entrained about a pair of spaced apart pulleys or sprockets 172 and 174. In the illustrated embodiment, pulley 172 serves as a drive pulley for the engagement device 154. As will be understood, drive pulley 172 drives the belt 170 to move the fingers 166 in timed relation with arrival of an ice cream filled container at the discharge station 18 of the transport and filling mechanism.

As illustrated in FIG. 9, drive pulley 172 is operatively connected to a free end of a rotatable drive shaft 176. The opposite end of drive shaft 176 is operatively connected to and driven by the drive mechanism 96 through any suitable force transfer means such that the container engagement device 154 is operated in timed relation with the transport and filling mechanism 12. Pulley 174 is rotatably supported from housing 158 as by a shouldered stub shaft 178.

The conveyor apparatus 156 leads away from the discharge station 18 of the transport and filling mechanism 12 and, when required, includes a device for automatically closing the lid on the container as it moves along the conveyor. As will be appreciated, the upper edge of the conveyor apparatus 156 is disposed at substantially the same height above the frame 14 as is the support mechanism 152. As such, an ice cream filled container is quickly and easily conveyed from the support mechanism 152 onto the conveyor apparatus 156 by the engagement device 154 and is removed from the area of the transport and filling mechanism 12 for subsequent handling.

In operation, empty ice cream containers move down the slide 140 and are positively moved by the supply mechanism 20 under the influence of pushers 144 toward the receiving station 16 of the transport and filling mechanism 12. As will be understood, the pushers 144 of the supply mechanism 20 are interchangeable such that the profile of each pusher 144 complements the particular ice cream container being filled.

At the receiving station 16, an empty ice cream container is provided by the supply mechanism 20 to each container support 30 of the continually moving transport apparatus 24 in a continuous motion. Arm 50 positively positions and holds the ice cream container on the container support 30 as the container moves along its predetermined path of travel. Notably, at the receiving station 16, the filling nozzle 78 is vertically spaced above the container C to be filled so as to not interfere with arm 50 positioning the container relative to the container support 30.

The cantilevered design of the transport apparatus 24 facilitates clean operation and holds each container separately beneath the filling apparatus so that board caliper and bouncing play of a container have substantially no effect thereby improving volumetric fill accuracy of the containers. Moreover, the wire structure 46 provided in combination with each container support 30 provides adequate side support for the containers during the filling process.

The transport apparatus 24 and the filling apparatus 26 preferably move conjointly such that multiple containers can be filled as they move along their predetermined path of travel. As the containers C are moved along their predetermined path of travel, the container support 30 for each container is vertically positioned relative to the filling nozzle 78 as a function of the angular disposition of the container support along the predetermined path of travel.

In the illustrated embodiment, the cam tracks 110 and 112 facilitate positioning of the container as it moves along its predetermined path of travel. Moreover, the balance mechanism 116 of the present invention urges the cam follower 114 on each container support 30 to follow the upper cam track 110 while permitting the container support 30 to be lowered as the container C supported thereon is filled with ice cream and with the volumetric fill of each container being sensed by sensor 90 to improve volumetric accuracy.

Figure 3:
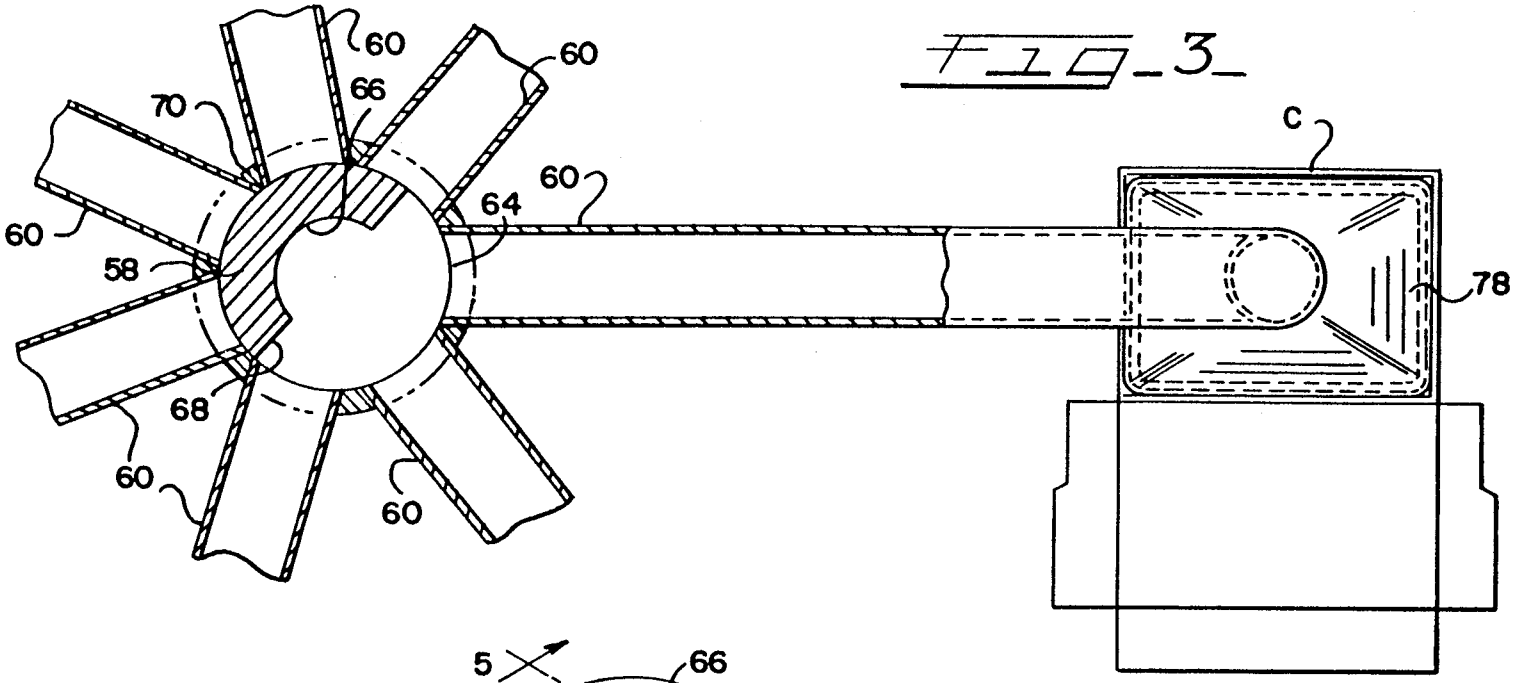
FIG. 3 is an enlarged fragmentary plan view taken along line 3—3 of FIG. 2.

In the illustrated embodiment, and more particularly as illustrated in FIGS. 2 and 3, the distribution manifold 58 of the filling apparatus 26 remains stationary while conduits 60 are moved relative thereto. As will be appreciated, when the inlet end of each conduit is joined in fluid communication with the ice cream outlet 68 of the distribution manifold 58, ice cream is fed through the conduits 60 and deposited into the container associated therewith.

The volumetric fill of each container is controlled by the speed with which the inlet end of a conduit moves past the ice cream outlet 68 of the manifold 58. The sensor 90, arranged at the discharge station 18, is provided to monitor the volumetric fill of the container. As mentioned above, volumetric fill of a container can be measured using any of several different methods. The sensor 90 provides a signal to the control station 92 regarding the volumetric fill of a container at the discharge station 18. The desired fill level is achieved when the container support 30 and the filled container thereon "float" between the upper and lower cam tracks 110 and 112, and are counter-balanced by the balance mechanism 116, as sensed by sensor 90.

The control station 9 interprets the data received from the sensor 90 and controls the drive mechanism 96 to automatically increase or decrease the speed with which the inlet end of the conduits pass the ice cream outlet 68 of the distribution manifold 58. If the sensor 90 indicates that the volumetric fill of each container C is too "light" the speed of the drive mechanism 80 will be slowed and, accordingly, more ice cream will be deposited in the container since the inlet end of the conduit is exposed to the ice cream outlet 68 for a longer period of time. If the sensor 90 indicates that the volumetric fill of each container is too "heavy" the speed of the drive mechanism 80 will be increased and, accordingly, less ice cream will flow to the ice cream container since the inlet end of the conduit is exposed to the ice cream outlet 68 for a shorter period of time. By constantly monitoring and automatically adjusting the speed of the transport and filling mechanism 12, inaccuracies regarding overfills or underfills of a container and general messiness of the apparatus can be substantially reduced.

As a container support 30 approaches the discharge station, the cam 130 acts against the cam follower 134 in a manner pivotally moving arm 50 against the action of spring 54. When the container support 30 reaches the discharge station, the arm 50 is sufficiently moved to not interfere with removal of the container from the container support 30.

Although each conduit 60 and filling nozzle 78 is filled with ice cream, when an ice cream filled container reaches the discharge station 18, the ice cream flow through the respective conduit associated with the container at the discharge station has been automatically stopped (inlet end of conduit 60 is removed from fluid communication with ice cream discharge outlet 68) and the filled ice cream container C is inhibited against continual movement with the transport apparatus 24 by the stationary stop 150. As illustrated in FIG. 9, at the discharge station, the container support 30 vertically positions the container such that the lowermost end of the filling nozzle 78 is located at an uppermost edge of the filled ice cream container.

Although the container is stopped, the design of the stationary stop 150, in combination with the design of the wire structure 46 for supporting the container, permits continued movement of the transport apparatus 24 and filling apparatus 26 toward the receiving station 16. Because the ice cream flow to the container has been automatically stopped, however, the relative movement between the filling nozzle 78 and the container slices or shears off the ice cream at the top of the container in a continuous motion whereby facilitating cleaner operation of the transport and filling mechanism. To further promote cleanliness during the filling operation, ice cream which inadvertently falls from either the container or the filling nozzle during their course of travel or at the discharge station is received in the trough 128.

At the discharge station, the support mechanism 152 vertically supports the stopped and filled ice cream container C after the container support 30 and wire structure 46 are removed from beneath the container in their continual movement toward the receiving station. The ice cream container C is vertically supported on the support mechanism 152 until a finger 166 of the removal apparatus 22 urges the container onto the conveyor apparatus 156 for subsequent removal from the area of the transport and filling mechanism 12. While moving along the conveyor apparatus 156 or shortly thereafter, the lid on the container is closed and the container is subsequently handled for packaging.

As will be appreciated, each container support 30 continually moves toward the receiving station 16 and another empty preassembled container is presented to the container support for subsequent filling by the transport and filling mechanism in the manner described above. The ability to fill multiple containers at one time yields increased production speeds and smooth, clean transfer of unfilled and filled cartons onto the transport and filling mechanism. Moreover, the constant monitoring of the volumetric fill of a container and automatic adjustments to the speed of the transport and filling apparatus promotes volumetric accuracy thus inhibiting overfilling and underfilling of the containers and avoids general messiness commonly associated with ice cream filling machines.

During a cleaning mode of operation, the annular chamber 135 is arranged in fluid communication with a cleaning and sterilizing medium, such as steam. Manual operation of mechanism 137 creates a camming action between cams 138 and pins 88 resulting in vertical displacement of hub 70. Vertical displacement of the hub 70 arranges the conduits 60 in communication with the annular chamber 135 thus allowing cleaning fluid to ultimately pass through the conduits to the filling nozzles. As such, the present invention offers the ability to internally clean and sterilize the conduits 60 without requiring disassembly of the filling apparatus 26. Therefore, cleaning time is minimized and operation of the filling apparatus 10 for production of filled containers is maximized.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An apparatus for filling containers with ice cream, said filling apparatus comprising:

means for continually moving at least one ice cream container along a predetermined path of travel;

means for filling said container with ice cream as the container continually moves along a segmented portion of its predetermined path of travel, said filling means comprising ice cream distribution means connected to a source of ice cream and defining an ice cream outlet, and conduit means movable relative to said ice cream outlet for delivering ice cream from said outlet to said container, said conduit means comprising at least one ice cream conduit having an inlet end which is moved into and out of fluid communication with said ice cream outlet, with ice cream passing through said conduit so long as the outlet end of the conduit and said ice cream outlet are joined in fluid communication relative to each other; and means for controlling the speed of movement of said conduit means relative to said outlet and of said container as it moves relative to said outlet along at least said segmented portion of its travel thereby affecting the volume of ice cream filled into said container by increasing the speed of movement to reduce the filling of said container, and by decreasing the speed of movement to increase the filling of said container, said controlling means comprising variable speed drive means for driving said container moving means and said conduit means in concert with each other relative to said ice cream outlet, and means for monitoring the quantity of ice cream with which said container is filled relative to a predetermined value, and for controlling the speed of said drive means to promote accuracy during filling of said containers.

2. The ice cream filling apparatus according to claim 1 wherein said moving means comprises means for individually supporting said container to facilitate clean operation and volumetric accuracy during filling of the container with ice cream.

3. The ice cream filling apparatus according to claim 2 wherein said moving means further includes means for vertically positioning said supporting means and the container supported thereby relative to said filling means as the container moves along its predetermined path of travel.

4. The ice cream filling apparatus according to claim 2 wherein said supporting means includes means for positively positioning and holding said container on said supporting means as said moving means moves said container along its predetermined path of travel.

5. The ice cream filling apparatus according to claim 1 wherein said moving means comprises means for individually supporting several ice cream containers in a cantilevered fashion, and said conduit means comprises a series of ice cream conduits, with each conduit radially extending from said distribution means and defining an inlet end which is moved relative to said outlet in said distribution means to permit ice cream to pass through a conduit so long as the inlet end of the conduit and said ice cream outlet are joined in fluid communication relative to each other.

6. The ice cream filling apparatus according to claim 5, wherein said moving means includes a discharge station whereat an ice cream filled container is stopped from further movement with said moving means.

7. The ice cream filling apparatus according to claim 6, wherein an opposite end of each conduit is fitted with a filling nozzle which is positioned to cut-off the ice cream at an upper edge of an associated container after the associated container reaches said discharge station.

8. The ice cream filling apparatus according to claim 1 further including means for selectively cleaning internal ice cream flow passages of said filling means without requiring disassembly thereof.

9. An apparatus for filling containers with ice cream, said filling apparatus comprising:

transporting means for supporting a plurality of ice cream containers for movement along a predetermined path of travel extending between a receiving station and a discharge station;

transporting means for supporting a plurality of ice cream containers are movement along a predetermined path of travel extending between a receiving station and a discharge station;

means for simultaneously filling more than one of said containers as the containers continually move along a segmented portion of their predetermined path of travel, said filling means comprising centrally disposed ice cream distribution means connected to a source of ice cream and defining an ice cream outlet, and multiple ice cream conduit means radially extending from said distribution means for delivering ice cream from said outlet to the containers as the containers move along their predetermined path of travel, each conduit means defining an inlet end and an exhaust end, said inlet end being moved relative to said ice cream outlet to permit ice cream to pass through said conduit means and fill one of said containers as long as said inlet end and said ice cream outlet are joined in fluid communication;

drive means for moving said transporting means and said filling means in timed relation relative to each other, and wherein the speed of movement imparted to said transporting means and said filling means is selectively varied to control the volume of ice cream filled into said containers by increasing the speed of movement to reduce the filling of said containers and by decreasing the speed of movement to increase the filling of said containers;

means for supplying empty ice cream containers to said transporting means at said receiving station;

means for removing filled ice cream containers from said transporting means at said discharge station; and means for monitoring the quantity of ice cream with which at least some of said containers are filled, and for controlling said drive means for controlling the speed of movement of said transporting means and said filling means.

10. The ice cream filling apparatus according to claim 9, wherein said transporting means includes a plurality of container supports which are positively driven along an arcuate path, each container support holding a container in a cantilevered fashion facilitating volumetric accuracy during filling of the containers.

11. The ice cream filling apparatus according to claim 10, wherein each container support includes means for positioning and retaining an ice cream container on the container support as the support moves between the receiving and discharge stations.

12. The ice cream filling apparatus according to claim 10 wherein each container support includes a wire structure configured to receive and hold a particularly configured container and which is interchangeably connected to said container support with a like wire structure to enhance versatility of the filling apparatus by accommodating different size and shape ice cream containers.

13. The ice cream filling apparatus according to claim 9 wherein said transporting means includes a plurality of cantilevered container supports, each container support being vertically positioned relative to said filling means during movement along a predetermined path of travel to facilitate filling of the containers carried on the container supports

14. The ice cream filling apparatus according to claim 9 wherein said supplying means is driven in timed relation with said drive means and presents containers in timed order to the transporting means at the receiving station.

15. The ice cream filling apparatus according to claim 14 wherein said supplying means includes a plurality of interchangeable pushers which individually engage and facilitate movement of the containers toward the receiving station.

16. The ice cream filling apparatus according to claim 9 wherein said removing means comprises a stationary stop which inhibits movement of the containers at a location along their predetermined path of travel, and a container engagement device driven in timed relation with said transporting means to positively remove stopped containers from the transporting means.

17. The ice cream filling apparatus according to claim 16 wherein said container engagement device includes a driven member which positively removes ice cream containers from their predetermined path of travel for movement to an area remote from the filling means.

18. The ice cream filling apparatus according to claim 9 further including means associated with said filling means for selectively directing a cleaning fluid through said distribution manifold and each of said conduit means in a manner facilitating internal cleaning of the filling apparatus.

19. A method of filling successive containers with ice cream or the like comprising the steps of:

providing means defining an outlet through which ice cream flows from an associated source;

moving preassembled ones of said ice cream containers in a supported manner along a predetermined path of travel relative to said outlet;

filling each said container with ice cream as the container moves along a segmented portion of its predetermined path of travel by joining said container in fluid communication with said outlet;

sensing the amount of ice cream with which at least some of said containers are filled; and controlling the speed of movement of successive ones of said containers at least along said segmented portion of its predetermined path of travel relative to said outlet in response to the amount of ice cream sensed in said containers thereby influencing the volume of ice cream deposited into said successive containers during said filling step by increasing the speed of movement to reduce the filling of the successive containers and by decreasing the speed of movement to increase the filling of the successive containers.

20. The method of filling containers with ice cream according to claim 19 comprising an initial step of:

presenting preassembled ice cream containers to a container transport apparatus at a receiving station for movement of the containers along said predetermined path of travel toward a discharge station.

21. The method of filling containers with ice cream according to claim 20 comprising the further step of:

stopping the ice cream containers at a removal station arranged adjacent said predetermined path of travel while permitting uninterrupted movement of the transport apparatus toward the receiving station.

22. The method of filling containers with ice cream according to claim 21 comprising the further step of:

removing ice cream containers from their predetermined path of travel at the discharge station while permitting continual movement of the transport apparatus toward the receiving station.

23. The method of filling containers with ice cream according to claim 19 comprising the further step of:

directing a cleaning fluid through a series of interconnected internal passages which direct a flow of ice cream from an ice cream source toward the ice cream containers to facilitate cleaning of such passages without requiring disassembly of the internal passages.

24. The method of filling containers with ice cream according to claim 19 comprising the further step of:

positioning said containers at different heights as the containers move along their predetermined path of travel to facilitate the filling process.

* * * * *

UNITED STATES PATENT AND TRADEMARK OFFICE

CERTIFICATE OF CORRECTION

PATENT NO. : 5,007,466

DATED : April 16, 1991

INVENTOR(S) : Martin J. Mueller, Martin Mueller and Michael A. Wiengandt

It is certified that error appears in the above-identified patent and that said Letters Patent is hereby corrected as shown below:

Column 9, line 10, "each" should be --Each--;

line 38, "through" should be --trough--;

Column 10, line 6, "13" should be --136--;

Column 11, line 34, "16" should be --164--;
lines 42-43, after "container", add --C--;

Column 13, line 17, "9" should be --92--;

Column 16, lines 7-10 should be deleted.

Signed and Sealed this

Twenty-seventh Day of October, 1992

*Attest:*

DOUGLAS B. COMER

*Attesting Officer*

*Acting Commissioner of Patents and Trademarks*